US009969545B2

(12) United States Patent
O'Neil et al.

(10) Patent No.: US 9,969,545 B2
(45) Date of Patent: May 15, 2018

(54) VEHICLE CARRIER

(71) Applicant: 2468336 Ontario Inc., Windsor (CA)

(72) Inventors: Christopher Norman O'Neil, Windsor (CA); James Theodore Dorner, Tecumseh (CA)

(73) Assignee: 2468336 Ontario Inc., Windsor (CA)

( * ) Notice: Subject to any disclaimer, the term of this patent is extended or adjusted under 35 U.S.C. 154(b) by 347 days.

(21) Appl. No.: 14/745,721

(22) Filed: Jun. 22, 2015

(65) Prior Publication Data

US 2016/0368702 A1 Dec. 22, 2016

(51) Int. Cl.
*B65D 85/68* (2006.01)
*B65D 19/12* (2006.01)

(52) U.S. Cl.
CPC ..... *B65D 85/68* (2013.01); *B65D 19/12* (2013.01); *B65D 2585/6865* (2013.01)

(58) Field of Classification Search
CPC ..... B65D 85/68; B65D 2585/6865; B65D 19/12; B65D 19/16; B65D 2585/686
USPC ..... 206/335, 386, 503, 509, 600; 217/37, 217/43 R; 220/4.28, 6, 7; 229/112–115
See application file for complete search history.

(56) References Cited

U.S. PATENT DOCUMENTS 2,490,804 A * 12/1949 Haas ..... B65D 9/06 206/335
3,302,843 A * 2/1967 Sheehan ..... B65D 5/00 206/315.9
3,688,968 A * 9/1972 Rathfon, III ..... B65D 19/06 206/335
4,097,611 A * 6/1978 Seiferth ..... B65D 5/4295 229/162.6
4,171,741 A * 10/1979 Fish ..... B65D 85/68 206/335
4,512,473 A * 4/1985 Thomaswick ..... B65D 85/48 206/600
4,570,417 A * 2/1986 Herr ..... B60P 3/064 206/335
5,456,189 A * 10/1995 Belle Isle ..... B65D 19/0095 108/57.17
6,585,126 B1 * 7/2003 Grigsby, Sr. ..... B65D 19/12 206/600
2003/0006149 A1 * 1/2003 Rudnick ..... A61B 17/06133 206/63.3
2003/0141207 A1 * 7/2003 Pai ..... B65D 19/0026 206/335

(Continued)

FOREIGN PATENT DOCUMENTS

EP 0837005 A1 4/1998
EP 1052193 A1 8/2003

*Primary Examiner* — Luan K Bui
(74) *Attorney, Agent, or Firm* — Blake, Cassels & Graydon LLP; Brett J. Slaney

(57) ABSTRACT

A carrier for vehicles having a base shaped like a quadrilateral, more specifically a parallelogram with unequal adjacent sides and no right angles. Furthermore, the base has a vertical support coupled through a housing to each vertex wherein the support is collapsible having an upright and a horizontal orientation. Each vertex of the frame comprises a target to permit the stacking of the carriers by allowing the vertical supports of a lower carrier to be inserted into the target of an upper carrier. The frame of the carrier is provided with means for securing the motorcycle to the frame and with entry chambers to lift the carrier using forklifts.

14 Claims, 9 Drawing Sheets

(56) References Cited

U.S. PATENT DOCUMENTS

2006/0011625 A1* 1/2006 Arnold ..... B65D 19/18
220/6

* cited by examiner

VEHICLE CARRIER

FIELD OF THE INVENTION

The invention relates to carriers for storing and transporting vehicles such as motorcycles or other two wheeled vehicles, and more particularly to carriers for large motorcycles.

DESCRIPTION OF THE PRIOR ART

Vehicles, and in particular two-wheeled vehicles such as motorcycles, are placed within carriers for transportation or storage. These carriers serve as pallets and provide a secure means to store and/or transport the motorcycle.

During storage, the loaded carriers are placed into warehouses or other holding facilities. Alternatively, the loaded carriers can also be placed into large containers such as shipping containers which are then connected to trucks or placed onto ships to facilitate the transportation of the containers from one location to another. Typically, the carriers known in the art are found to be rectangular in shape with a width that generally corresponds to lengths of the two-wheeled vehicles they carry. When placed into the containers for shipping, the carriers are arranged in the containers generally transverse to the length of the container to permit a number of carriers to fit into a single carrier.

The width of the shipping containers is standardized across the transportation industry to make the transportation more efficient. Therefore, as the carriers must fit within the container, there is a limit to how long the length of these carriers can be.

It is known that a large variety of motorcycles exist, meaning these two-wheeled transportation vehicles come in a wide variety of sizes. The sizes can range from small to large. Some exemplary large motorcycles include cruisers and touring motorcycles. Over time, the size of these larger motorcycles has continuously increased, reaching a point where their length exceeds the width of shipping containers. As such, it is not possible to place as many motorcycles into a single container as was previously possible. As a consequence of the aforementioned drawbacks, it has proven increasingly difficult and inefficient to transport a large number of motorcycles using carriers presently available.

It is therefore an object of the invention to obviate or mitigate the above limitations.

SUMMARY OF THE INVENTION

In one aspect the present invention provides a carrier for vehicles such as two-wheeled vehicles, three-wheeled vehicles, snow mobiles, or four-wheeled vehicles. The carrier having a base frame comprised of a first pair of opposite sides and a second pair of opposite sides joined in quadrilateral formation, more specifically in the form of a parallelogram. Particularly, the opposing sides of the base have equal length, the adjacent sides are unequal in length, and all angles are non-right angled. Furthermore, the frame is provided with at least one baseplate to constitute a platform for at least partly supporting a ground engaging portion of the vehicle.

In another aspect the carrier is provided with a collapsible vertical support member coupled to each vertex of the base frame through a housing, each housing having a releasable latch to secure the vertical support in an upright orientation.

In another aspect the underside of each housing is a target which permits entry of nesting caps located on the vertical support, making the carriers stackable.

In another aspect the carrier is provided with at least one passage extending between the second pair of sides and parallel to the first pair of sides. Additionally, the passage may have one end open to permit entry of at least one ground engaging portion of a vehicle and the other end may have a bumper to restrict the rolling out of the ground engaging portion.

In another aspect a first pair of opposing sides of the carrier are extendable in length through the use of telescopic rails. Furthermore, each vertex of the carrier is provided with a pivoting joint to allow for the altering of the angle between each side of the first pair of opposing sides and its adjacent side.

BRIEF DESCRIPTION OF THE DRAWINGS

Embodiments of the invention will now be described by way of example only with reference to the accompanying drawings in which.

The features of the invention will become more apparent in the following detailed description in which reference is made to the appended drawings.

DETAILED DESCRIPTION OF THE INVENTION

While the following examples are directed to a carrier for a two-wheeled vehicle such as a motorcycle, it will be appreciated that the principles discussed herein can also be adapted to accommodate vehicles having greater or less than two wheels or other conveyance mechanisms such as tracks, skis, etc. as described in greater detail below.

Figure 1:
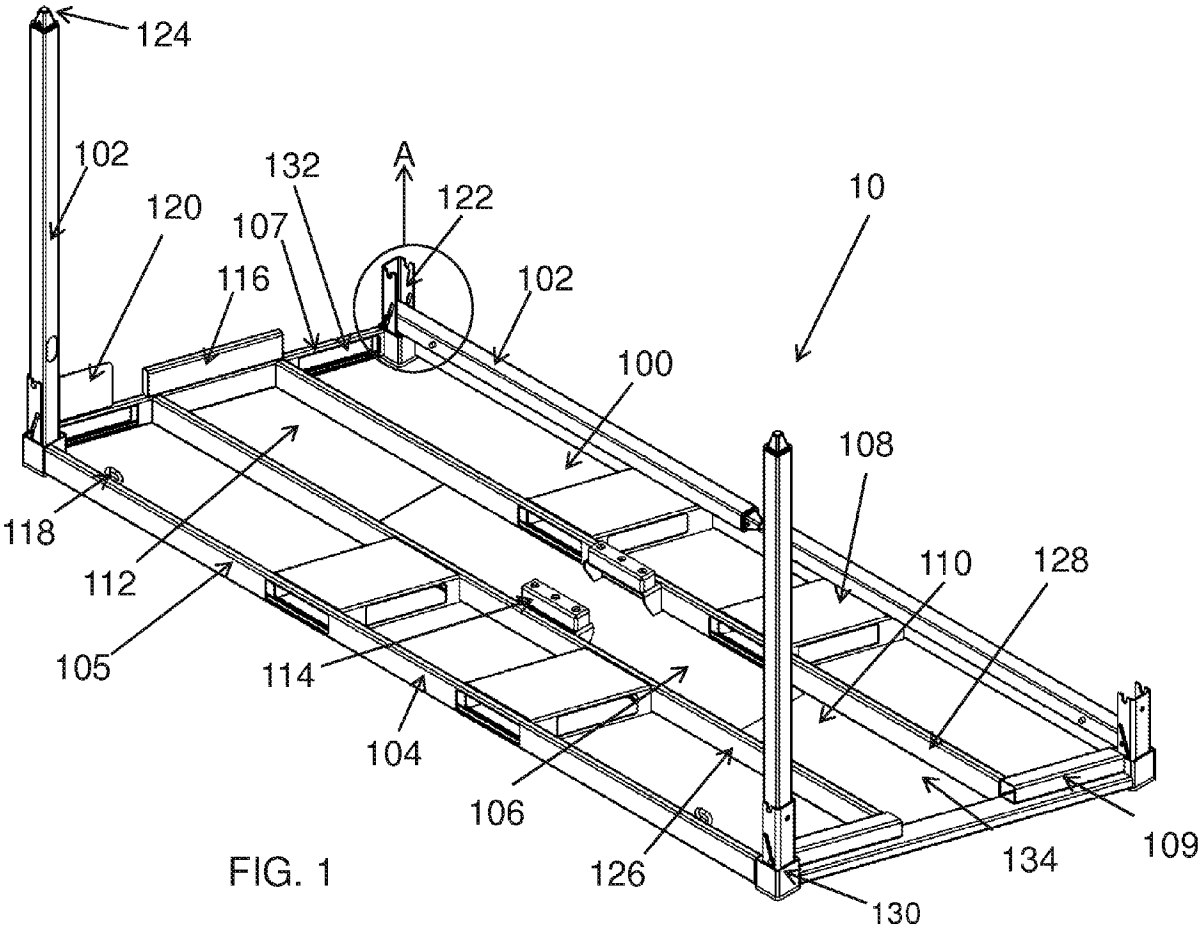
FIG. 1 is a perspective view of a vehicle carrier.
Figure 2:
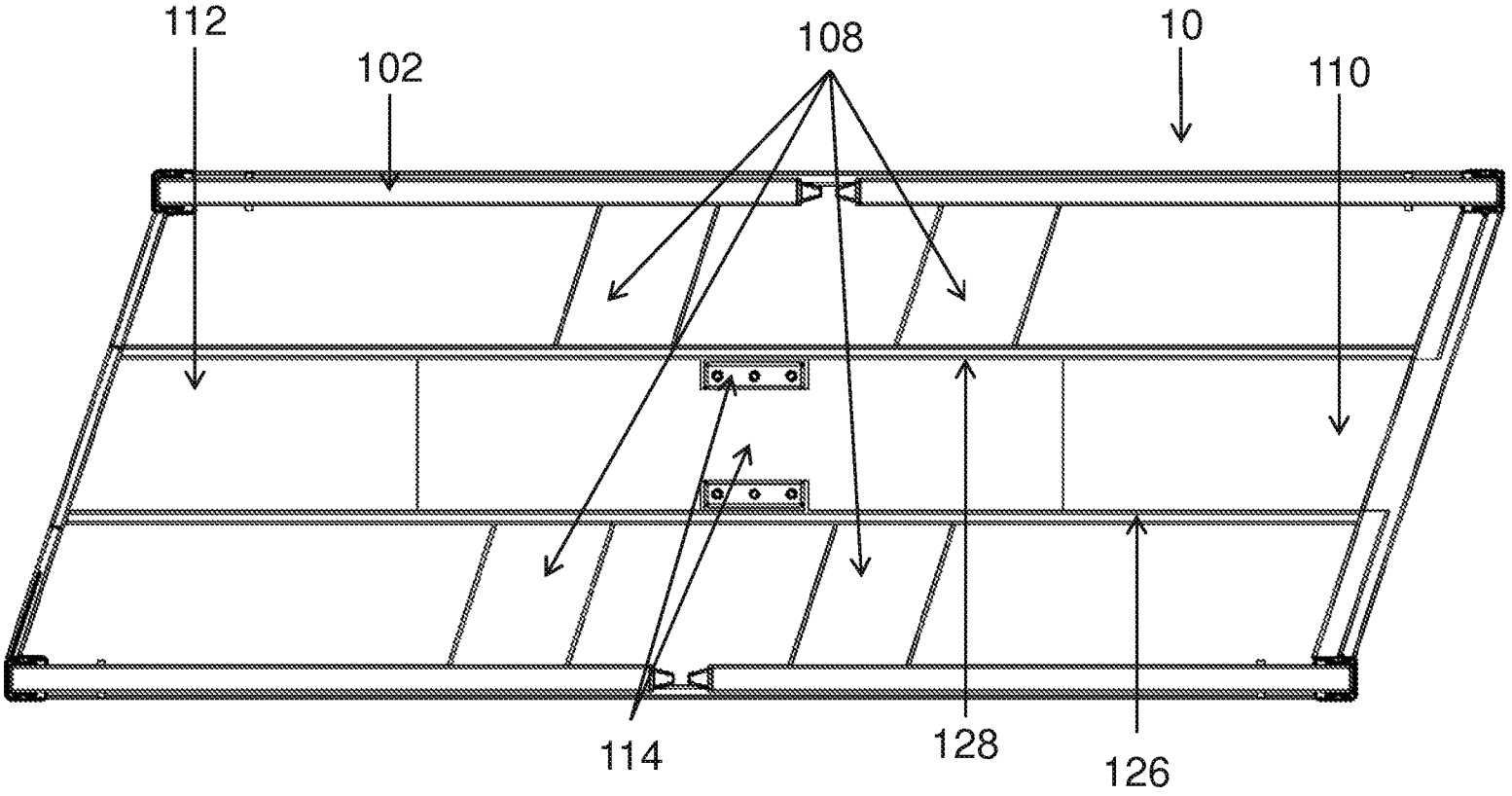
FIG. 2 is a top plan view of the vehicle carrier shown in FIG. 1.

As seen in FIGS. 1 and 2 a carrier 10 for two-wheeled vehicles such as motorcycles comprises a base 100 and a vertical support 102 at each vertex 130. The vertical support 102 is coupled to the base 100 through a housing 122.

The base 100 comprises a base frame 104 shaped generally like a quadrilateral, more specifically a parallelogram in which the opposing sides of the base have equal length, the adjacent sides are unequal in length, and all angles are non-right angled. Particularly, frame 104 has a pair of longitudinal members to form longitudinal sides 105 and a pair of transverse members to form transverse sides 107. The opposing sides 105 and 107 of the frame 104 are substantially of equal length and the opposing angles are also generally equal.

The frame 104 of the base 100 comprises a central passage 106. The central passage 106 is formed by a pair of spaced members 126 and 128 which are joined to the members forming transverse side 107. The spaced members 126 and 128 are attached to the middle of frame 104 with each spaced member 126 and 128 being roughly equidistant and parallel to the longitudinal sides 105. The members 126 and 128 are spaced, in this embodiment to allow a tire for motorcycles to fit between them. The central passage 106 has an opening 134 formed by the placement of shortened members 109 along one transverse side 107 of the frame 104. The frame 104 has a plurality of tie down supports 118 attached to its sides.

The central passage 106 has baseplates 110 and 112 at opposite ends extending between the members 126 and 128 such that they provide a closed floor portion to a first end and second end of the central passage 106 respectively. It will be appreciated that in an alternate embodiment a continuous baseplate extending the entire length of the passage 106 can also be used. The central passage 106 also has one tie down block 114 attached to member 126 and another tie down block 114 attached to member 128. Each tie down support is attached near the midpoint of the respective member. Each tie down block 114 is made of high-density polyethylene; however it will be appreciated that other materials such as steel or wood can be used.

A bumper 116 is attached to the frame 104 at the opposite side of the opening 134, near the baseplate 112. The bumper is sized to act as a restraint for tires in contact with the baseplate 112 and inhibits them from rolling out of the frame 104 during movement of the carrier 10. The bumper 116 can be made of rubber, plastic, or other such material.

A label plate 120 is attached to the frame 104 and can be marked with a number or tag identifying the carrier.

A first pair of spaced entry chambers 108 are disposed between one longitudinal side 105 of frame 104 and member 126. Furthermore, a second pair of spaced entry chambers 108 are disposed between the opposing longitudinal side 105 of frame 104 and member 128. Each pair of entry chambers 108 is spaced and shaped to allow for the insertion of a forklift or other lifting or elevating mechanism into the frame 104. In the exemplary embodiment four entry chambers are shown but it will be appreciated that more or fewer can be used depending on the device used for lifting and moving the carrier 10. The entry chambers 108 are parallel to the axis of transverse side 107 so that a forklift may lift and drive the carrier 10 into a shipping container shaped generally like a rectangle, such as container 30 shown in FIG. 6. Furthermore the frame 104 also comprises holes 132 located in the transverse sides 107 on each side of the bumper 116. The holes 132 align with holes in the entry chambers 108 to serves as an alternate point of entry for a forklift or other lifting device.

Figure 3:
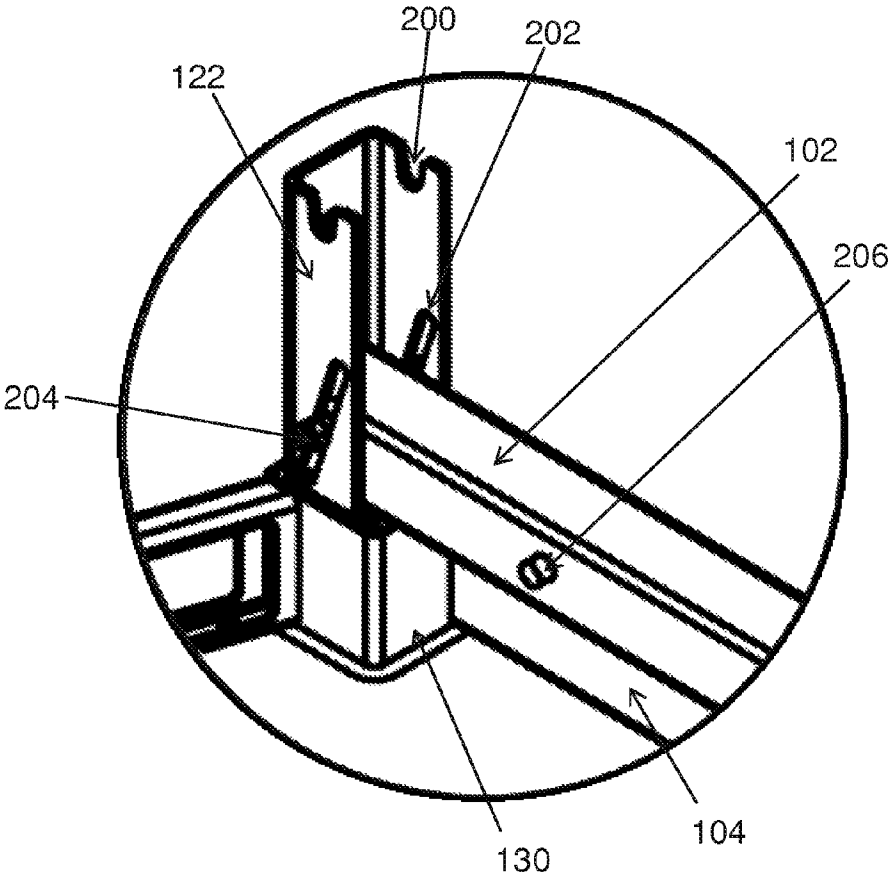
FIG. 3 is an enlarged fragment of a portion of the vehicle carrier labelled A in FIG. 1.

As shown in FIG. 3, the collapsible supports 102 are each coupled to the base 100 through a housing 122. A housing 122 is placed at each vertex 130 of the frame 104. The housing 122 is shaped like a rectangular box having one open face. The opposing sides of the housing 122 have a recess 200 at their top and diagonal slits 202 near the bottom. The vertical support 102 has a first pin 204 and a second pin 206. The first pin is slidably coupled to the slit 202. The diagonal orientation of the slit 202 and its engagement with the pin 204 allows the vertical support 102 to be in line with a longitudinal side 105 of the frame 104 when the support 102 is placed in a folded or horizontal configuration. The second pin 206 is positioned such that it fits into the recess 200 when the support 102 is rotated to be upright. The support 102 is therefore able to each be placed in an upright configuration or can be collapsed into a horizontal configuration. The underside of each housing 122 is concave to provide a target which permits the entry of caps such as nesting cap 124 located at the top of each support 102, making the carriers stackable. It can be appreciated that in some application (e.g., where stacking is not required), the carrier frame 104 can be used to convey or store a vehicle without requiring any supports 102.

Figure 4:
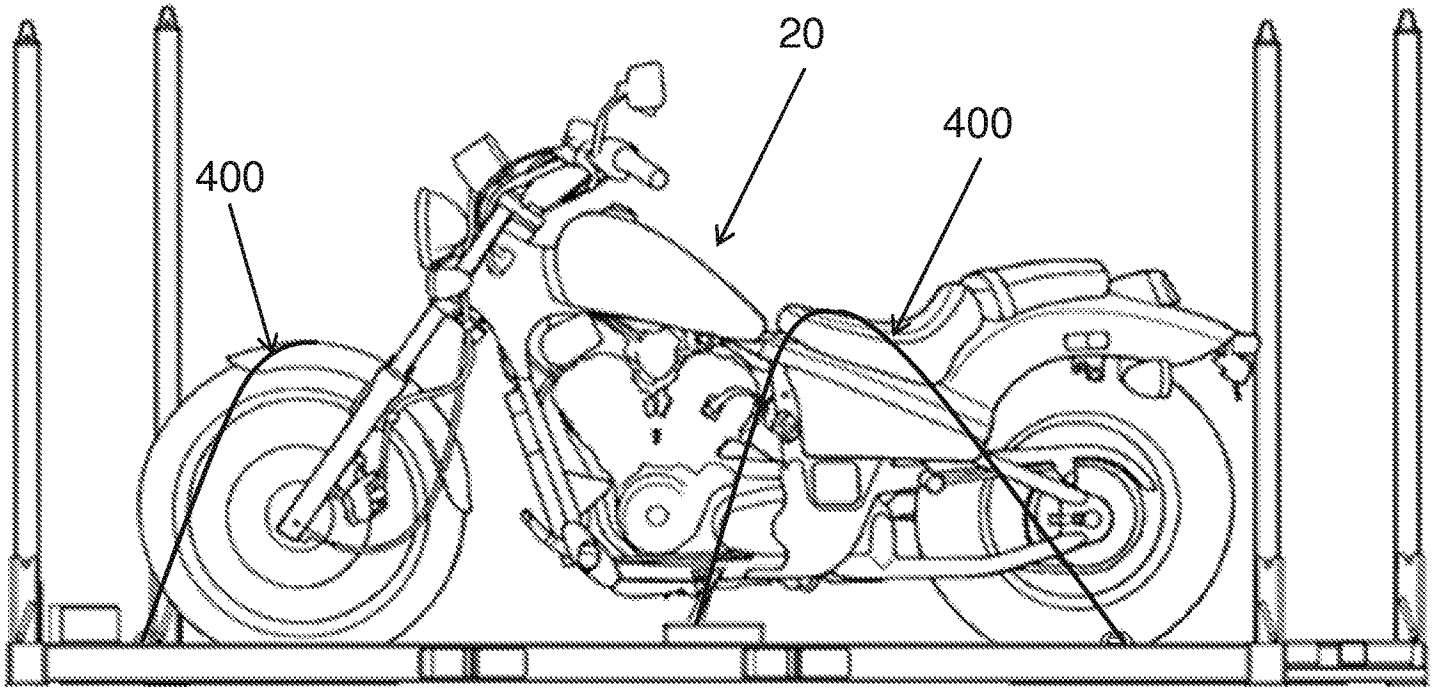
FIG. 4 is a side view of a vehicle carrier shown in FIG. 1, loaded with a motorcycle.

In operation, a two-wheeled vehicle such as motorcycle 20 shown in FIG. 4 is placed into the carrier 10 by passing a first wheel of the motorcycle 20 through the opening 134 in the central passage 106. The motorcycle 20 is then advanced through the central passage 106. As the motorcycle 20 is advanced through the central passage 106 a second wheel of the motorcycle 20 passes through the opening 134. The motorcycle is advanced until the first wheel comes into contact with the bumper 116. However, it will be appreciated that the orientation of the motorcycle 20 can be in such that the front of the motorcycle is entered first or in reverse.

When the motorcycle 20 is in the desired placement in the carrier 10, belts 400 can be used in conjunction with the tie down block 114 and tie down supports 118 to secure the motorcycle 20 to the carrier 10.

When it is desired to move the loaded carrier 10, the forks or tines of a forklift (not shown) can be inserted into the frame 102 through the chambers 108 or the openings 132. The container can then be subsequently lifted using the forklift. The forklift can be either manually operated or a machine driven by an operator.

It will be appreciated that during the placement of the motorcycle 20 and the lifting of the carrier 10 the supports 102 can either be in the upright or horizontal orientation.

Figure 5:
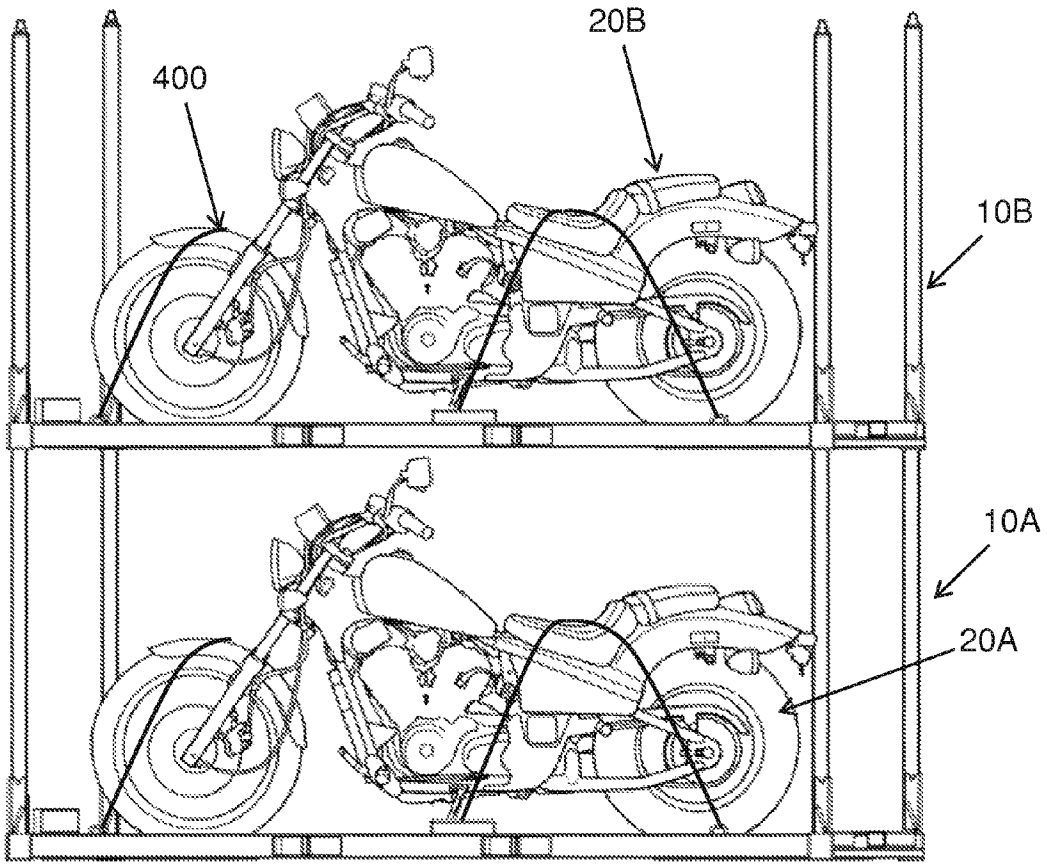
FIG. 5 is a side view of loaded vehicle carriers shown in FIG. 4, in a stacked configuration.

As seen in FIG. 5, the carriers 10 are stackable. A second carrier 10B can be stacked on top of a first carrier 10A. During the stacking, the vertical supports of the first container 10A are placed in an upright orientation by rotating the support 102 until the pin 206 rests in the recess 200. The second carrier 10B is then positioned above the first carrier 10A such that cap 124 of the first carrier 10A is directly above the target in the underside of housing 122 of the carrier 10B. The carrier 10B can then be lowered until the caps 124 and a portion of the support 102 of carrier 10A are securely coupled to the housing 122 of carrier 10B.

Figure 6:
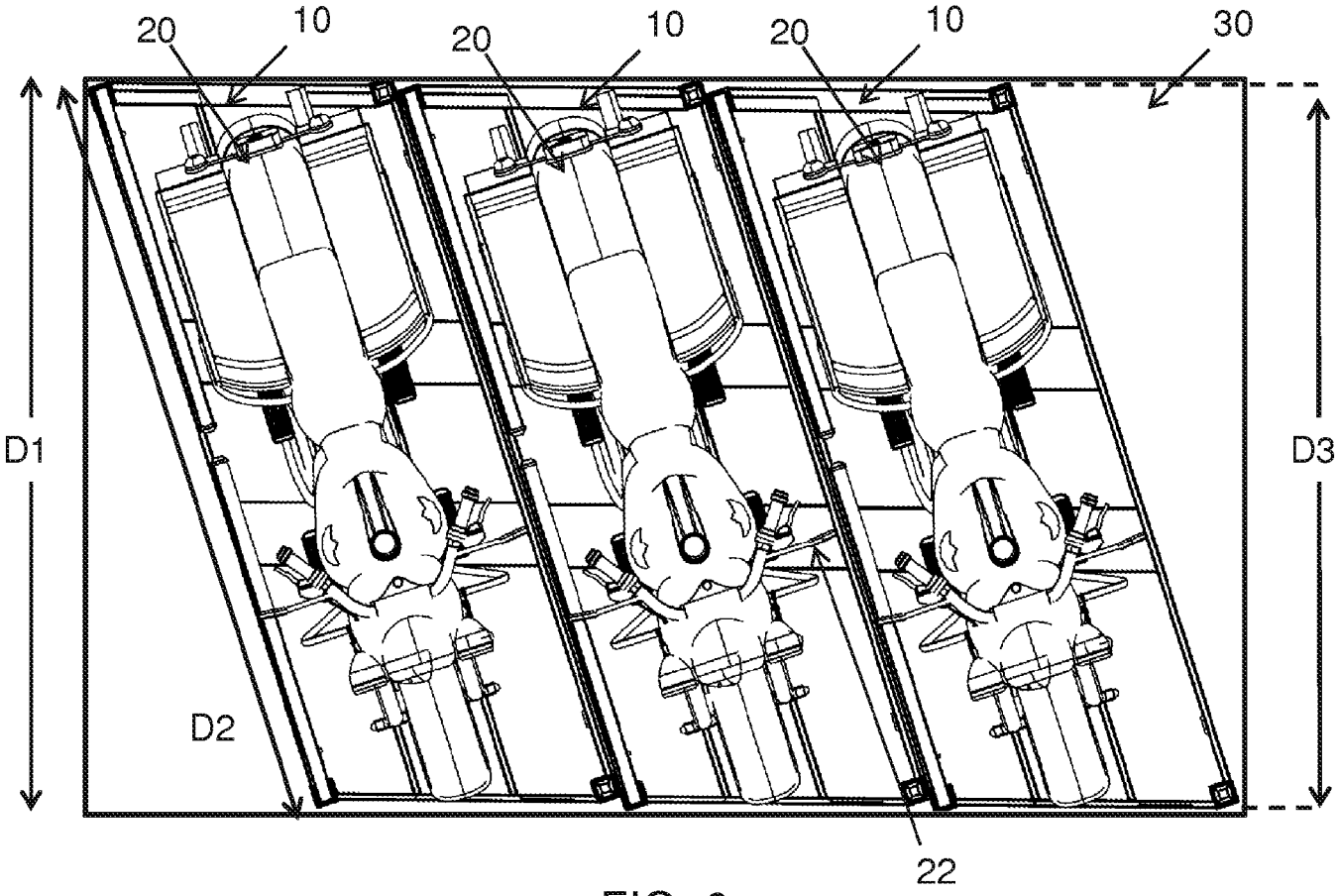
FIG. 6 is a top plan view of a plurality of vehicle carriers shown in FIG. 1 arranged within a shipping container.

It will be appreciated that due to the shape of the carrier 10, they can be easily inserted into shipping containers such as container 30 shown in FIG. 6. A plurality of carriers 10 having a diagonal length of D2 (corresponding to lengths of motorcycle 20) being larger than the width D1 of container 30 can be placed into the container 30. This is possible because the height D3 of the carrier 10 corresponds generally to the width D1 of container 30. This now permits an efficient and secure means to place motorcycles into containers 30, especially in situations where the length of the motorcycle is greater than the length of the container 30.

It will also be seen that due to the shape of the carrier 10, the handlebars 22 of motorcycles 10 become staggered and as such do not come into contact with one another. This staggering of the handlebars permits the carriers 10 to have a width shorter than the length of the handlebars. The permits the carriers 10 to be narrower and as such more carriers 10 can potentially be loaded into a container 30.

Figure 7:
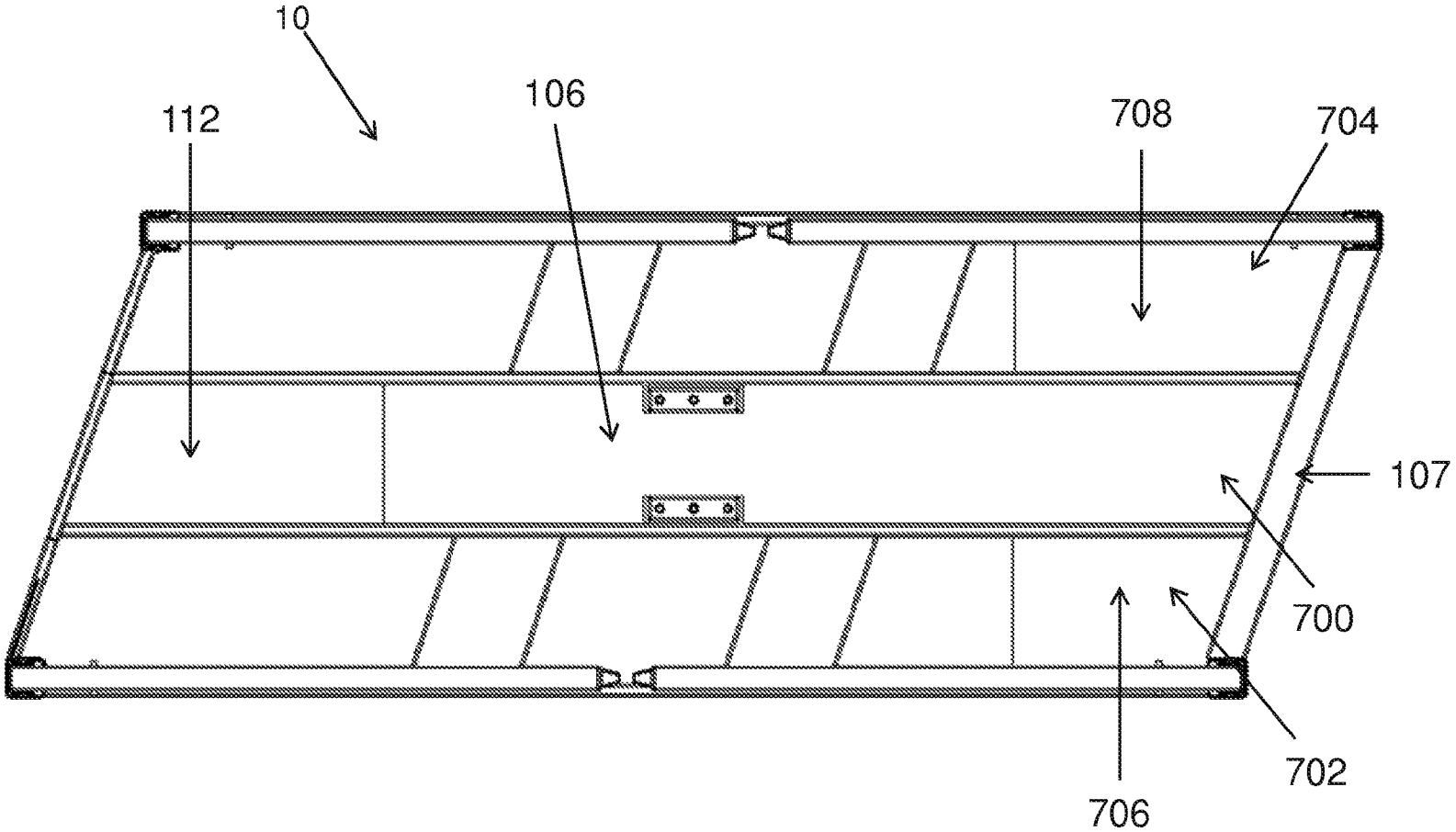
FIG. 7 is a top plan view of an alternate embodiment of the vehicle carrier of FIG. 1.

As noted previously, the principles discussed herein can also be applied to other types of vehicles. For example, the carrier 10 can be modified to accommodate a three-wheeled vehicle as shown in FIG. 7. It can be seen that in this embodiment the transverse side 107 does not have shortened tubes. As such, there is a continuous opening 700 along one transverse side. Additionally the portion 702 of the frame, defined as being between the central passage 106 and one longitudinal side 105, has a baseplate 706 to support one rear wheel of a three-wheeled vehicle. Furthermore the portion 704 of the frame, defined as being between the central passage 106 and the other longitudinal side 105, has a baseplate 708 to support the other rear wheel of a three-wheeled vehicle.

When loading the three-wheeled vehicle into the carrier 10 shown in FIG. 7, the three-wheeled vehicle is loaded by passing a front wheel through the opening 700 and into the central passage 106. The vehicle is then advanced through the central passage 106 until the rear wheels pass through the opening 700 wherein one wheel enters into the portion 702 and the other wheel into the portion 704. The vehicle is further advanced until the front wheel is resting on the baseplate 112 and one rear wheel is resting on each baseplate 706 and 708 respectively. The vehicle can then be secured to the frame 104 using belts or other fastening means.

Figure 8:
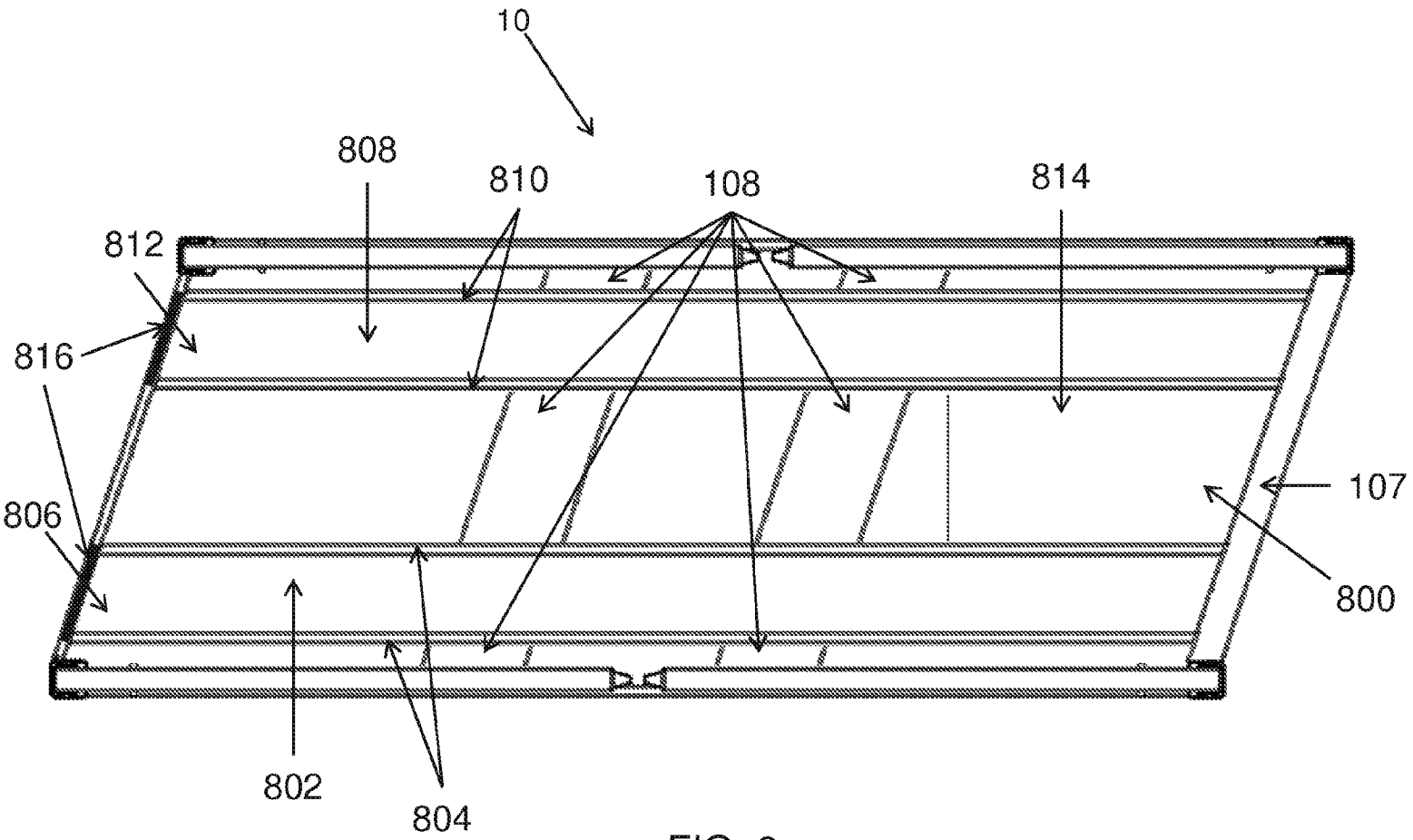
FIG. 8 is a top plan view of a further alternate embodiment of the vehicle carrier of FIG. 1.

A further embodiment of the carrier 10 adapted for vehicles such as snowmobiles or four-wheeled vehicles is shown in FIG. 8. In this embodiment the transverse side 107 also does not have shortened tubes, as such; there is a continuous opening 800 along one transverse side. Additionally a first track 802 on the frame 104. The first track 802 is formed by a pair of spaced members 804 joined to the transverse sides 107 and has a baseplate 806 extending between the members 804. The first track 802 is attached to the frame 104 near one longitudinal side 105 with each spaced member 804 being parallel to the longitudinal sides 105. Similarly, a second track 808 is formed by a second pair of spaced members 810 joined to the transverse sides 107 and has a baseplate 812 extending between the members 810. The second track 808 is attached to the frame 104 near the other longitudinal side 105 with each spaced member 810 being parallel to the longitudinal sides 105. The members 804 and 810 are each spaced, in this embodiment, to allow a ski of a snowmobile or a tire of a four-wheeled vehicle to fit between them respectively. This embodiment may further comprise a baseplate 814 extending between the tracks 802 and 808 respectively. Additionally a bumper 816 can be situated at the end of track 802 and 806 at the side opposite to the opening 800 to act as a restraint and keep tires from rolling out of the tracks.

In the embodiment shown in FIG. 8, the members 804 and 810 can have slits to allow the tines of a forklift to pass through them and into the entry chambers 108. Alternatively, the tracks 802 and 808 can also be above the entry chambers 108 to ensure the tines do not come into contact of the tires or skis situated in the tracks.

When loading a four-wheeled vehicle into the carrier 10 shown in FIG. 8, the four-wheeled vehicle is loaded by passing the front wheels through the opening 800 such that one front wheel is in track 802 and the other front wheel in track 808. The vehicle is then advanced through the tracks until the rear wheels pass through the opening 800 wherein one rear wheel enters into the track 802 and the other rear wheel into the portion track 808. The vehicle is further advanced until the front wheels come into contact with the front bumpers 816. The vehicle can then be secured to by frame by using belts or other fastening means.

Alternatively, when loading a snowmobile into the carrier 10 shown in FIG. 8, the skis situated at its front are passed through the opening 800 such that one ski is in track 802 and the ski in track 808. The vehicle is then advanced through the tracks until the track situated at its rear passes through the opening 800. The vehicle is further advanced until the rear tracks are situated on the baseplate 814. The vehicle can then be secured to by frame by using belts or other fastening means.

Figure 9:
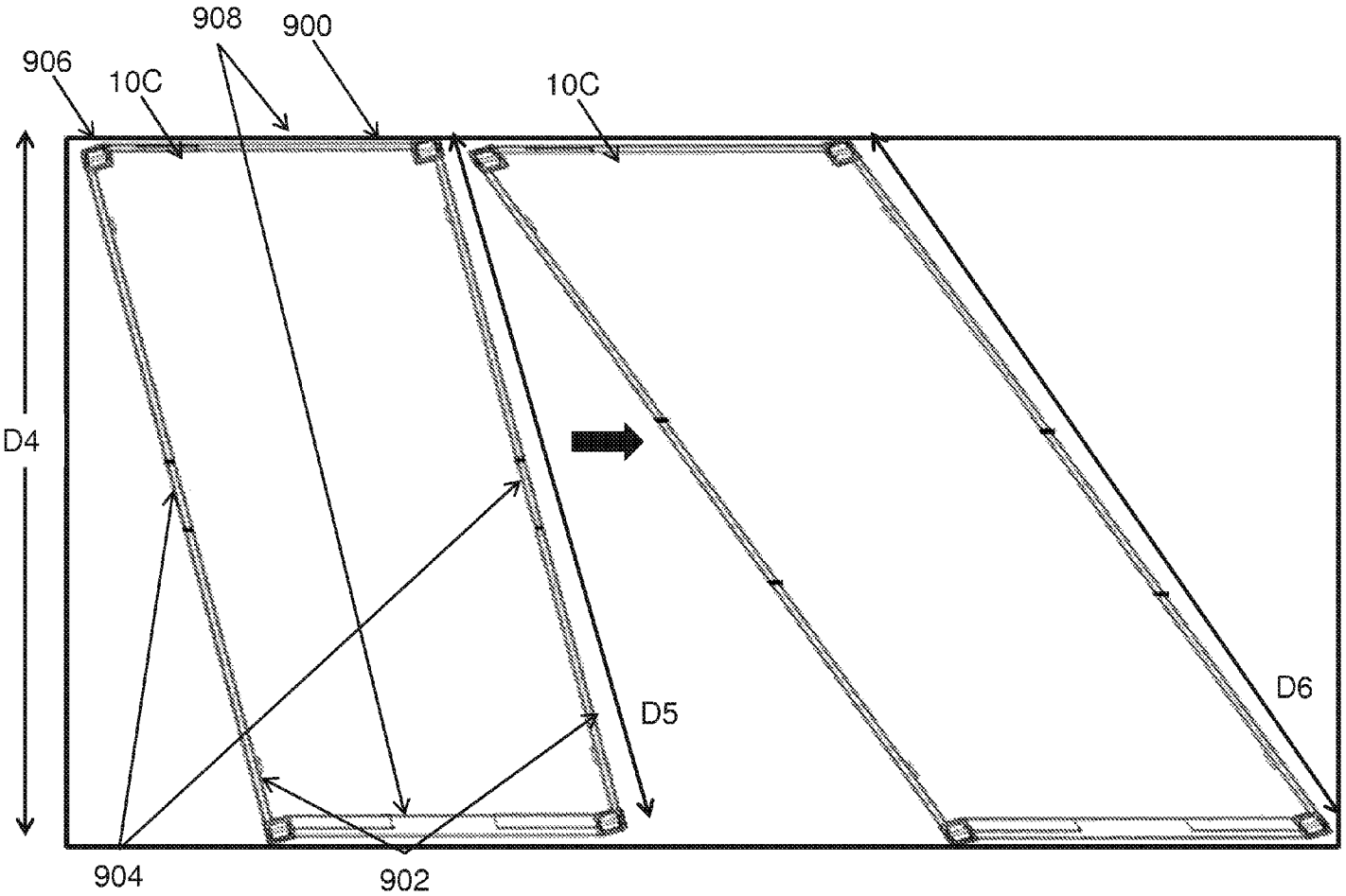
FIG. 9 is a top plan view of a further alternate embodiment of the vehicle carrier of FIG. 1.

In a further alternate embodiment shown in FIG. 9, the vehicle carrier 10C has an adjustable frame 900. The frame 900 can be adjusted to increase or decrease the length of the longitudinal sides 902 as the sides are comprised of members having a telescopic rail 904. The telescopic rail 904 of each longitudinal side 902 can be lengthened or shortened to accommodate longer or shorter vehicles. In this embodiment each vertex of the frame 900 is comprised of a rotatable joint 906 to permit relative movement between each longitudinal side 902 and transverse side 908. As such, when the longitudinal sides 902 are extended, the rotatable joint 906 allows the longitudinal sides 902 to pivot such that the angle between a longitudinal side 902 and its adjacent transverse side 908 can be adjusted. The rotatable joint can be formed from a pin and latch mechanism wherein the pin is used to lock the angle into place. It will be appreciated that this adjustability permits the ability to increase the diagonal length of a carrier 10C from D5 to D6 while still being able to fit inside a container having a width D4. Once the length of the sides has been adjusted additional members to form passages or tracks in the frame 104 can be attached along with the desired baseplates and entry chambers.

The frame 104 is shown as being made of steel tubes. These tubes can have any desired cross section such as square or rectangular. The thickness of the tubing can be varied to ensure the frame is of sufficient strength as required to support the vehicle. However, it will be appreciated that other material such as wood, plastic or carbon fiber can also be substituted for the construction of the frame 104. It can also be appreciated that the carrier 10 can be made from a combination of these materials. The vertical supports 102 of the carrier 10 are shown to have a square cross section. However, this can also be varied as necessary.

The invention claimed is:

1. A carrier for vehicles, the carrier comprising:

a) a base frame comprising four sides connected in a quadrilateral formation, a first pair of the sides opposing each other in a substantially parallel relation to each other, and being of substantially equal length, a second pair of the sides being adjacent to and connecting the first pair of the sides, the angles between adjacent sides in the base frame being non-right angled such that one opposing pair of corners is acute, and the other opposing pair of corners is obtuse, and such that a first distance defined by a length of the second pair of the sides is greater than a distance between the first pair of the sides to permit angled loading of the carrier into a shipping container for a vehicle whose length is greater than a width of the shipping container, wherein each corner of the base frame allows relative motion between the first and second pairs of the sides to adjust the angle between the sides and to increase or decrease the distance between the first pair of sides to permit the carrier to fit within shipping containers of different widths, and wherein at least one passage is provided to guide entry of at least one wheel of the vehicle, the passage being formed by two elongated members joined to the base frame, the elongated members extending between the first pair of the sides of the base frame;

b) at least one baseplate connected to the base frame to at least in part support corresponding ground engaging portions of the vehicle and position the vehicle within an area defined by the sides of the base frame; and c) a vertical support member coupled at a lower end to each corner of the base frame to enable another vehicle carrier to be stacked on the carrier.

2. The carrier of claim 1, wherein the vertical support members are collapsible.

3. The carrier of claim 2, wherein the vertical support members are coupled to the base frame via corresponding housings, each housing having a releasable latch to secure the vertical support in an upright orientation.

4. The carrier of claim 1, wherein the four sides define a parallelogram.

5. The carrier of claim 1 wherein the width of the passage corresponds to the width of a tire of the at least one wheel.

6. The carrier of claim 1 wherein one end of the base frame is provided with a bumper to limit movement of the vehicle through the carrier.

7. The carrier of claim 6 wherein the opposing end of the base frame is provided with an opening to permit passage of the vehicle into the carrier.

8. The carrier of claim 3 wherein the underside of each housing provides a concave target to permit the housing of a first carrier to mate with the vertical supports of a second carrier and permit stacking of the carriers.

9. The carrier of claim 1 wherein the base frame comprises at least one support to allow securing of the vehicle to the carrier.

10. The carrier of claim 3 wherein the vertical support members when collapsed rest parallel to and atop the length of the base frame.

11. The carrier of claim 1, further comprising at least one pair of entry chambers coupled to the base frame to permit the entry of forklift tines to lift the carrier.

12. The carrier of claim 1 wherein each of the second pair of the sides are extendable in length.

13. The carrier of claim 12 wherein each of the second pair of the sides has a telescopic rail to adjust its length.

14. The carrier of claim 1 wherein each corner has a releasable latch to secure the angle between the sides after an adjustment.

* * * * *